US010676258B2

(12) United States Patent
Lee et al.

(10) Patent No.: US 10,676,258 B2
(45) Date of Patent: Jun. 9, 2020

(54) CHILD-RESISTANT, FLIP-TOP CLOSURE

(71) Applicant: Rieke Corporation, Auburn, IN (US)

(72) Inventors: Yen Kean Lee, Rohnert Park, CA (US); Fidel Aragon, Windsor, CA (US)

(73) Assignee: RIEKE LLC, Auburn, IN (US)

( * ) Notice: Subject to any disclaimer, the term of this patent is extended or adjusted under 35 U.S.C. 154(b) by 0 days.

(21) Appl. No.: 15/894,977

(22) Filed: Feb. 13, 2018

(65) Prior Publication Data

US 2018/0229903 A1 Aug. 16, 2018

Related U.S. Application Data

(60) Provisional application No. 62/458,211, filed on Feb. 13, 2017, provisional application No. 62/518,634, filed on Jun. 13, 2017.

(51) Int. Cl.
*B65D 50/04* (2006.01)
*B65D 47/08* (2006.01)

(52) U.S. Cl.
CPC ..... *B65D 50/046* (2013.01); *B65D 47/0804* (2013.01); *B65D 47/0838* (2013.01)

(58) Field of Classification Search
CPC .. B65D 50/00–046; B65D 47/00–0838; B65D 50/048; B65D 50/06; B65D 50/061; B65D 50/062; B65D 50/063; B65D 50/064; B65D 50/065; B65D 50/066; B65D 50/067; B65D 50/068; B65D 50/069; B65D 55/02; B65D 2555/02; B65D 55/089; B65D 2215/00–08
See application file for complete search history.

(56) References Cited

U.S. PATENT DOCUMENTS 6,305,563 B1 * 10/2001 Elliott ..... B29C 45/0081 215/235
6,550,626 B1 * 4/2003 Randall ..... B65D 41/3442 215/253
6,866,164 B2 * 3/2005 Branson ..... B65D 47/0814 222/153.14
7,404,495 B2 * 7/2008 Keung ..... B65D 47/0804 215/216

(Continued)

OTHER PUBLICATIONS

Clever Pack, Child Resistant Cap CP 1.1, http://www.cleverpack.com.brien/p_standard_a_01.html, downloaded Apr. 23, 2018.

(Continued)

*Primary Examiner* — Kareen K Thomas
(74) *Attorney, Agent, or Firm* — McDonald Hopkins LLC

(57) ABSTRACT

A child-resistant, flip-top closure includes a closure body for secure connection to a container which stores the content/product which is to be dispensed. Hinged to the closure body is a flip-open lid which is constructed and arranged to be lifted manually. A child-resistant structure is incorporated into the closure construction. The child-resistant structure of one exemplary embodiment is constructed and arranged with a squeeze-to-release feature. The child-resistant structures of other exemplary embodiments are constructed and arranged with a tab press-down feature. Actuation of the child-resistant structure (squeeze or press down) must be performed concurrently with the lifting action applied to the flip-open lid.

17 Claims, 21 Drawing Sheets

(56) References Cited

U.S. PATENT DOCUMENTS

| | | | | |
|---|---|---|---|---|
| 8,292,101 | B1 * | 10/2012 | Bragg | B65D 47/0838 215/237 |
| 8,596,493 | B2 * | 12/2013 | Vollers | B65D 47/0838 215/211 |
| 9,764,879 | B2 * | 9/2017 | Koenigseder | B65D 47/0804 |
| 2005/0205607 | A1 * | 9/2005 | Hierzer | B65D 47/0804 222/153.1 |
| 2006/0186077 | A1 * | 8/2006 | Robinson | B65D 47/0814 215/237 |
| 2006/0186079 | A1 * | 8/2006 | Ziegenhorn | B65D 47/0809 215/237 |
| 2007/0095864 | A1 * | 5/2007 | Vangeel | B65D 47/0828 222/556 |
| 2007/0125741 | A1 * | 6/2007 | Keung | B65D 47/0804 215/237 |
| 2007/0144996 | A1 * | 6/2007 | Sawyer | B65D 47/0809 215/235 |
| 2010/0044378 | A1 | 2/2010 | Giraud | |

OTHER PUBLICATIONS

Packaging World, Stull Technologies: Child-resistant closure, http://www.packworld.com/package-component/closures/stull-technologies-child-resistant-closure, downloaded Apr. 23, 2018.

* cited by examiner

CHILD-RESISTANT, FLIP-TOP CLOSURE

RELATED APPLICATION AND FIELD OF INVENTION

This application claims priority United States provisional patent application Ser. No. 62/458,211, filed on Feb. 13, 2017, and 62/518,634, filed on Jun. 13, 2017. Both of these disclosures are incorporated by reference as if fully rewritten herein.

BACKGROUND

Child-resistant closures are well known and widely used on a variety of containers as a way to try and protect children from inadvertently gaining access to the (product) contents of those containers. In theory, it is believed that young children have difficulties in making two different manipulations concurrently, such as a squeeze-together manipulation at the same time of a twist or turn manipulation. Accordingly, if the child-resistant closure requires two such manual manipulations to be performed concurrently, it is assumed that young children will have difficulty in opening these types of containers and ideally will not be able to open these types of containers.

The overall closure constructions and desired features of child-resistant closures may be dictated or at least influenced to some extent by the type of product to be retained and dispensed. For example, closures designed for particulate products, such as some medications, may have a construction which is different from closures designed for liquids. For example, closures which are designed for liquids may require additional sealing in order to prevent leakage while a dry particulate product likely does not present that concern. As such, the design of the child-resistant features for these types of closures may be influenced to some extent by the type of product to be retained and dispensed.

If the child-resistant features which are integrated into a closure are too complicated and/or too difficult to manipulate, then opening of the closure, i.e. the opening of the container for dispensing of the product, may be difficult for certain adults, such as those with arthritic conditions in their hands. Accordingly, it would be an improvement to provide a child-resistant closure which provides the necessary safeguards for young children while at the same time providing a closure which is more user-friendly and easier to open by adults with arthritic conditions in their hands.

SUMMARY

Disclosed herein as exemplary embodiments of the present invention are child-resistant closures with a flip-top lid or flip-top cap construction. In terms of this selected terminology, the top portion of the closure which needs to be flipped up or hinged open in order to gain access to the container contents has the form of the lid or cap which is hinged to the closure body. The terms "lid" and "cap" as used herein are considered to be interchangeable and refer to the top hinged member or portion which closes off the corresponding dispensing opening. The selected hinge construction may be either a living hinge or may be constructed and arranged as a separate snap-together hinge structure.

In each disclosed embodiment the closure body is threaded onto a container neck and includes a ratchet locking feature so as to securely connect the closure to the container. Design variations are contemplated wherein the connection to the container is by some other construction, such as using a snap-on closure to replace the threaded connection. A further design variation makes the ratchet locking construction optional. As described, a flip-top closure lid is hinged to the closure body, preferably by a living hinge to enable molding the closure lid and the closure body combination as a single-piece construction. As noted, one design option is to form the hinged connection from two components with a snap-together construction. As described, the flip-top lid needs to be opened or flipped up into an open condition in order to have access to the container contents and to be able to dispense the product which is stored or retained within the container. The closure body in each disclosed embodiment includes a dispensing opening which is in communication with the interior of the container and which is closed by the lid when the lid is hinged into a down or closed condition. It is not until the lid is flipped up or hinged in an upward direction to an open condition that normal access to the product is enabled.

The incorporation of a unique child-resistant construction into each exemplary embodiment of the present invention influences the ability of the user or person desiring access to flip up the lid. Only after the child-resistant features are concurrently manipulated can the flip-top lid be moved (i.e. hinged upwardly) to an open condition so as to open the dispensing opening and gain access to the contents of the container. In other words, defeating the child-resistant feature requires two separate manual manipulations to be performed concurrently. Importantly, the exemplary embodiments of the present invention are constructed and arranged to be user-friendly for adults, particularly those having limitations in hand dexterity due to arthritis. The exemplary embodiments of the present invention provide improved constructions for child-resistant, flip-top closures.

Further forms, objects, features, aspects, benefits, advantages, and embodiments of the present invention will be apparent from the detailed description and drawings provided here with.

BRIEF DESCRIPTION OF THE DRAWINGS

Operation of the disclosure may be better understood by reference to the following detailed description taken in connection with the following illustrations. Any numbers or printed indicia on the drawings are hereby incorporated within this written disclosure, and such numbers are indicated in U.S. inches and are incorporated herein.

DETAILED DESCRIPTION

Figure 1:
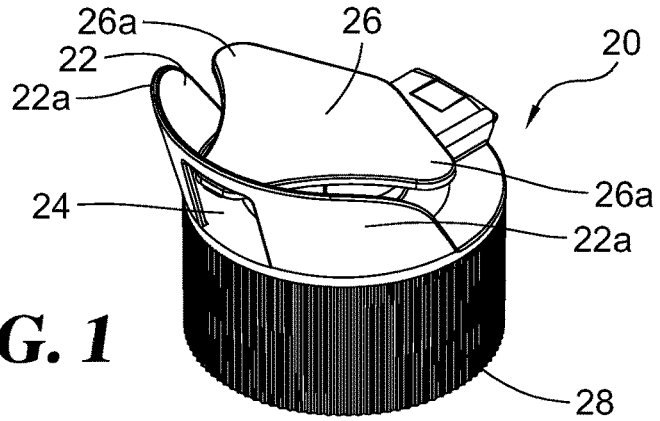
FIG. 1 is a perspective view of a child-resistant, flip-top closure in a closed condition according to one embodiment of the present invention.
Figure 2:
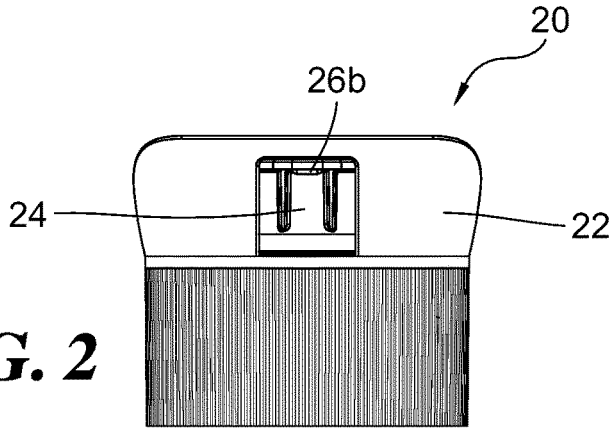
FIG. 2 is a left side elevational view of the FIG. 1 closure.
Figure 3:
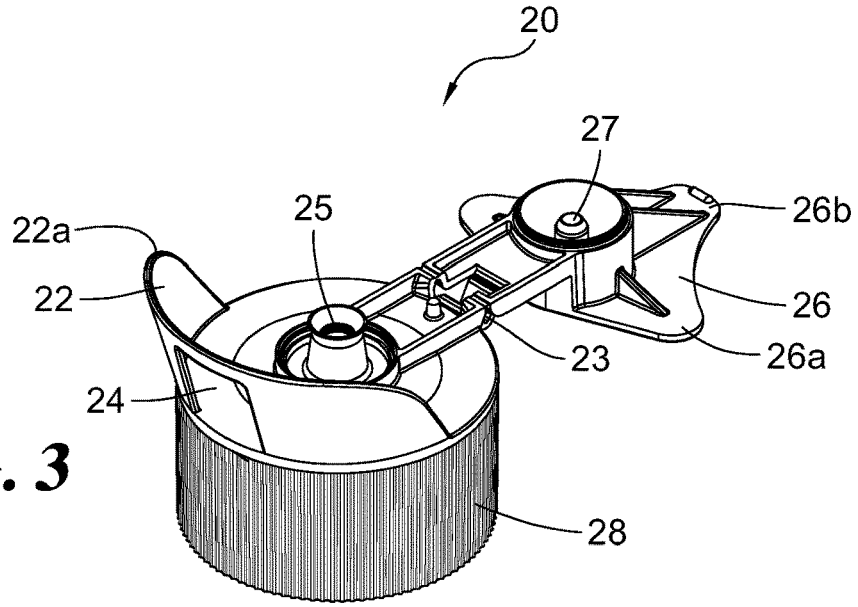
FIG. 3 is a perspective view of the FIG. 1 closure in an open condition.
Figure 4:
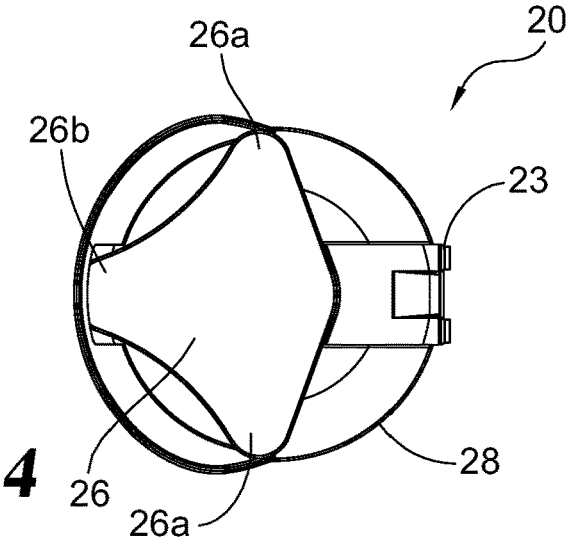
FIG. 4 is a top plan view of the FIG. 1 closure.
Figure 5:
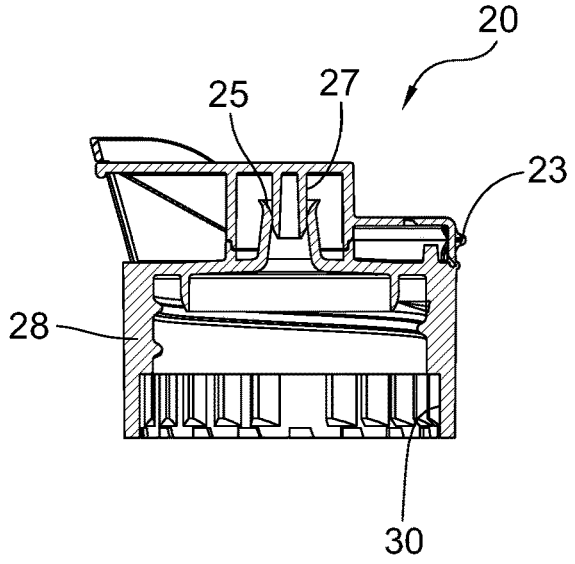
FIG. 5 is a front elevational view, in full section, of the FIG. 4 closure.
Figure 6:
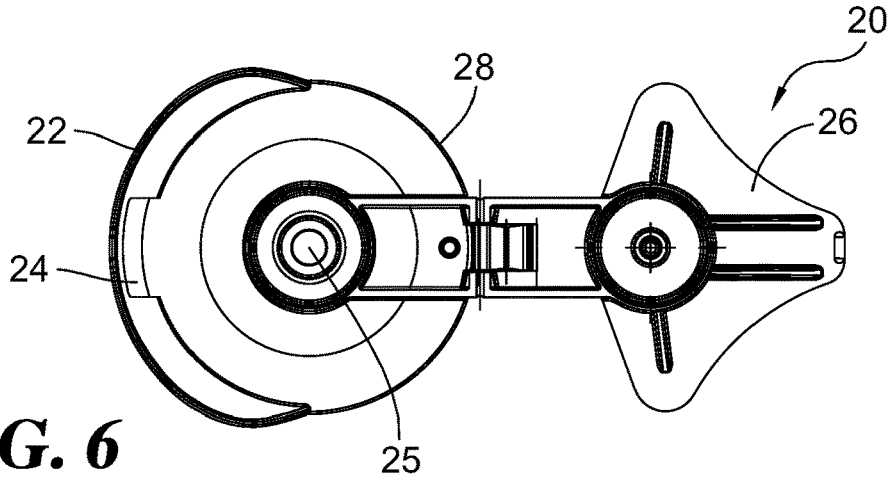
FIG. 6 is a top plan view of the FIG. 3 closure.
Figure 7:
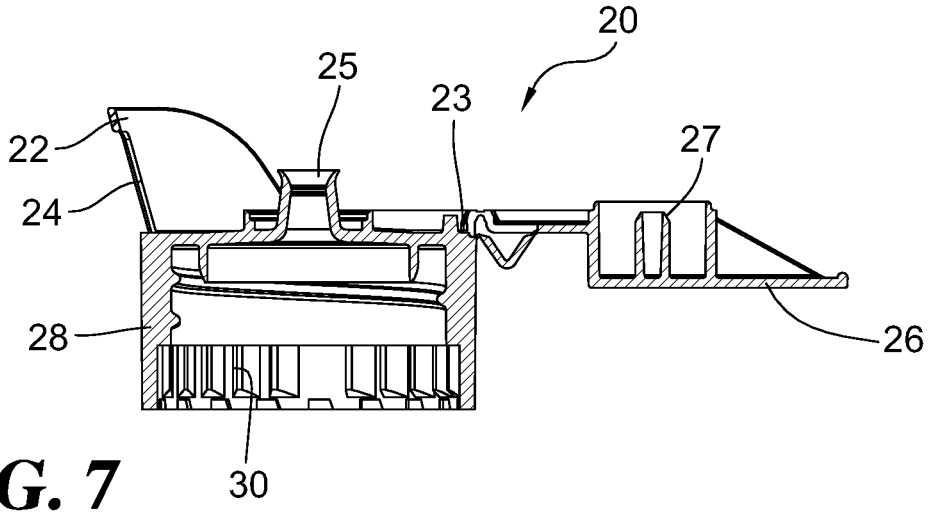
FIG. 7 is a front elevational view, in full section, of the FIG. 6 closure.
Figure 8:
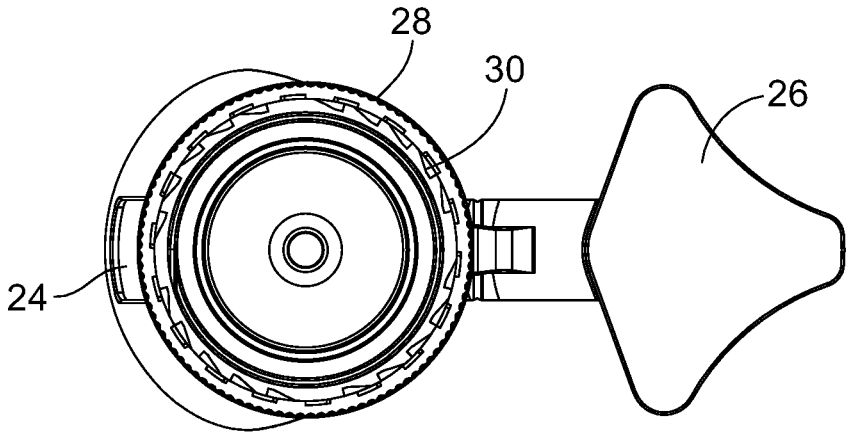
FIG. 8 is a bottom plan view of the FIG. 6 closure.
Figure 9:
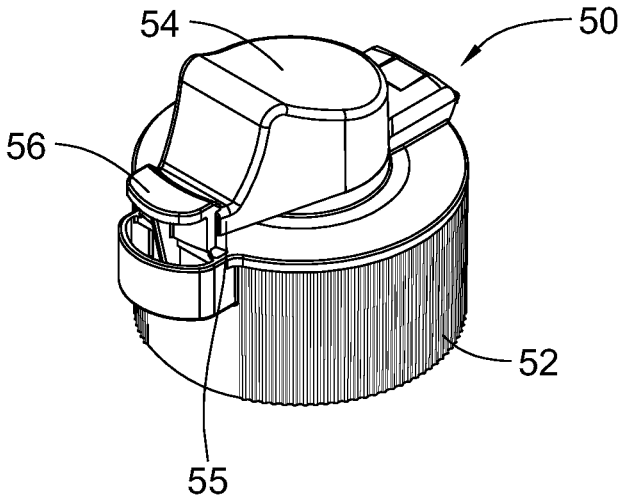
FIG. 9 is a perspective view of a child-resistant, flip-top closure in a closed condition according to one embodiment of the present invention.
Figure 10:
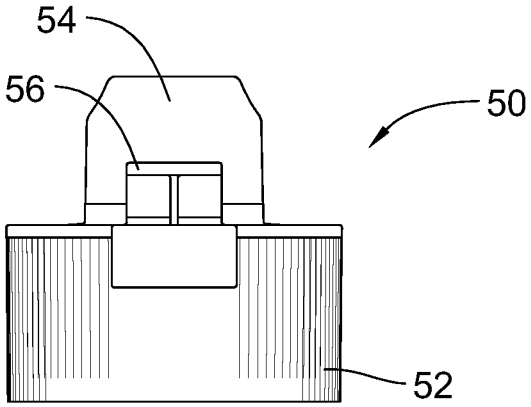
FIG. 10 is a left side elevational view of the FIG. 9 closure.
Figure 11:
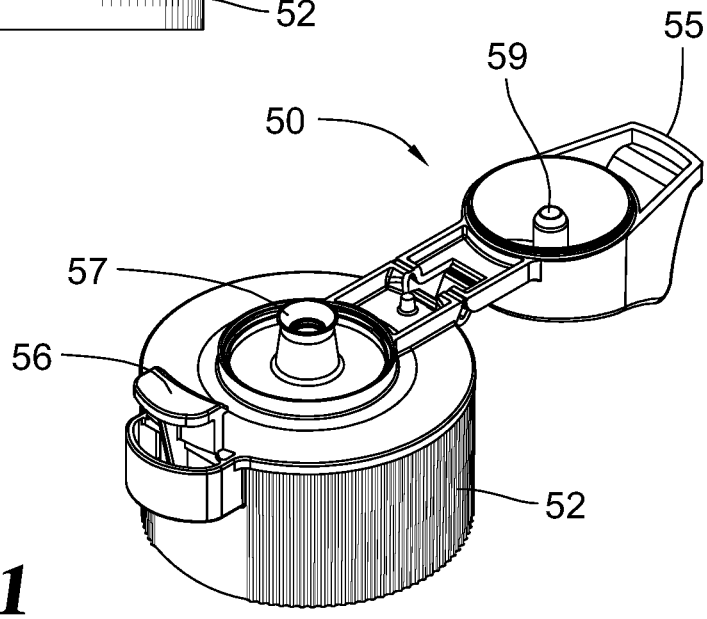
FIG. 11 is a perspective view of the FIG. 9 closure in an open condition.
Figure 12:
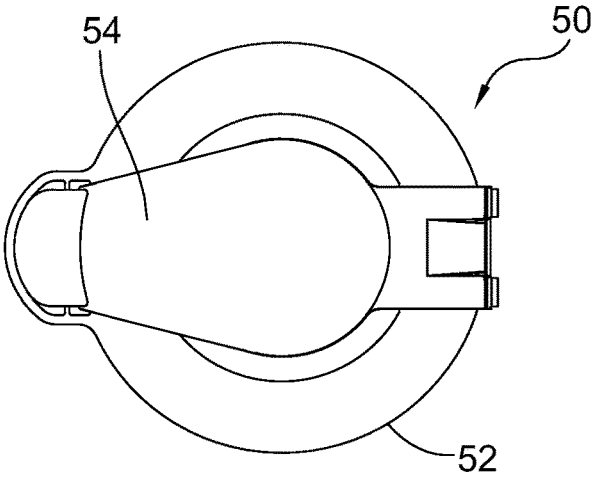
FIG. 12 is a top plan view of the FIG. 9 closure
Figure 13:
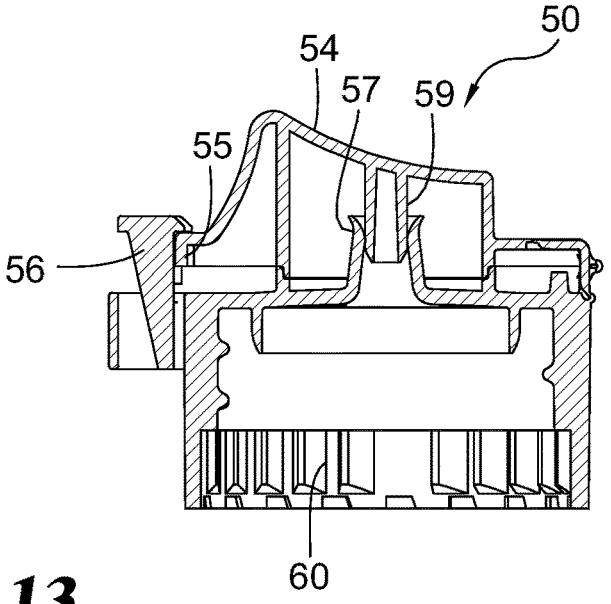
FIG. 13 is a front elevational view, in full section, of the FIG. 12 closure.
Figure 14:
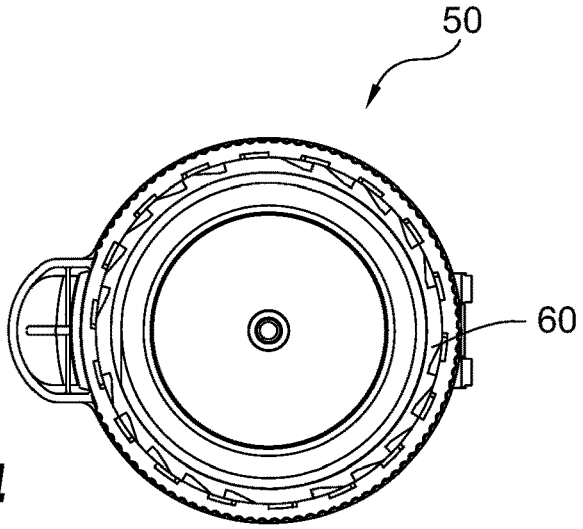
FIG. 14 is a bottom plan view of the FIG. 12 closure.
Figure 15:
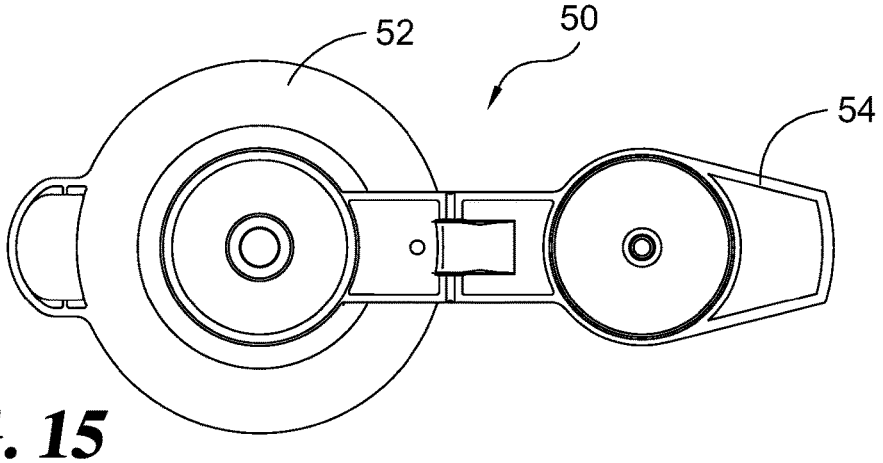
FIG. 15 is a top plan view of the FIG. 11 closure.
Figure 16:
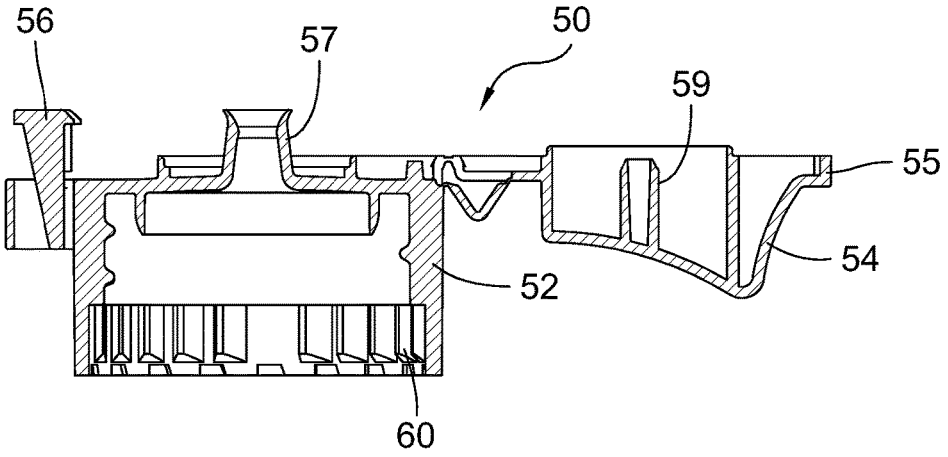
FIG. 16 is a front elevational view, in full section, of the FIG. 15 closure
Figure 17:
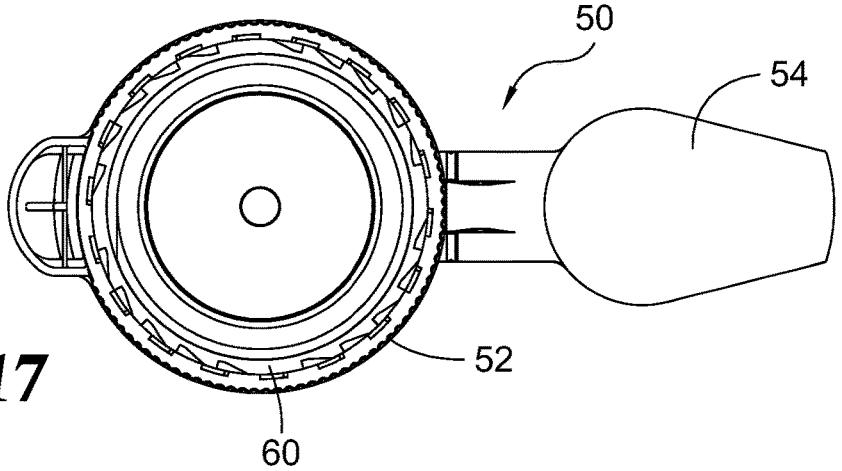
FIG. 17 is a bottom plan view of the FIG. 15 closure.
Figure 18:
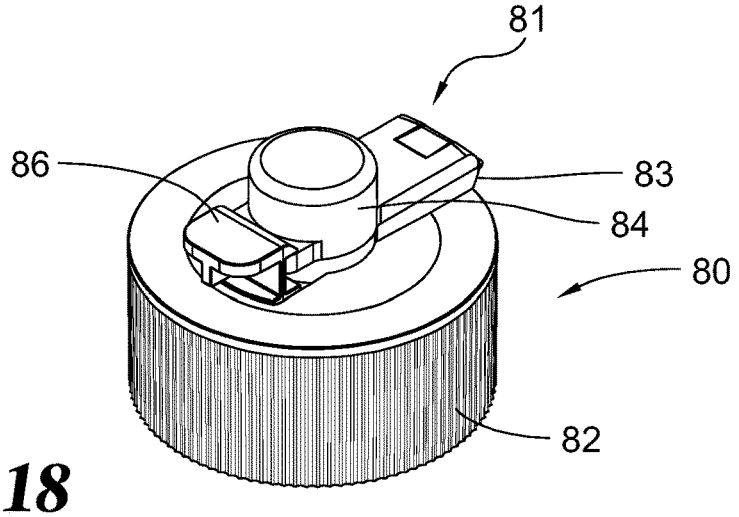
FIG. 18 is a perspective view of a child-resistant, flip-top closure in a closed condition according to one embodiment of the present invention.
Figure 19:
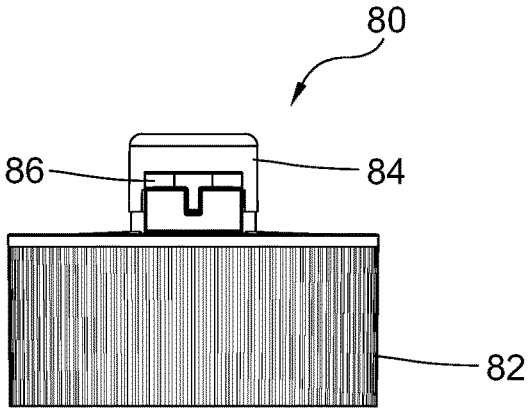
FIG. 19 is a left side elevational view of the FIG. 18 closure.
Figure 20:
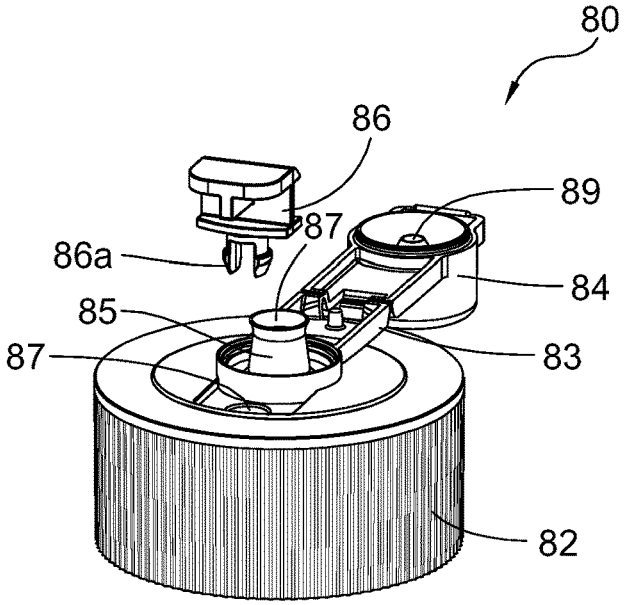
FIG. 20 is an exploded, perspective view of the FIG. 18 closure in an open condition.
Figure 21:
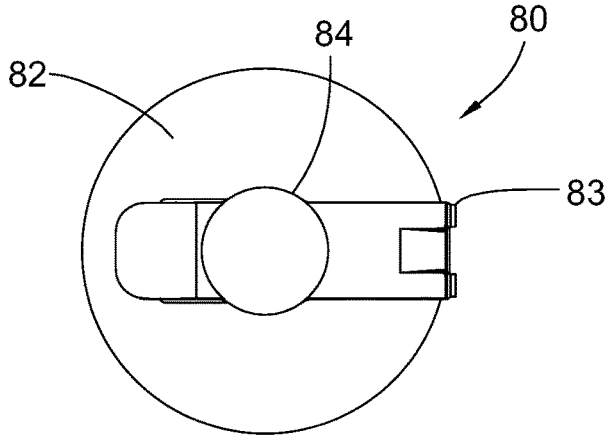
FIG. 21 is a top plan view of the FIG. 18 closure.
Figure 22:
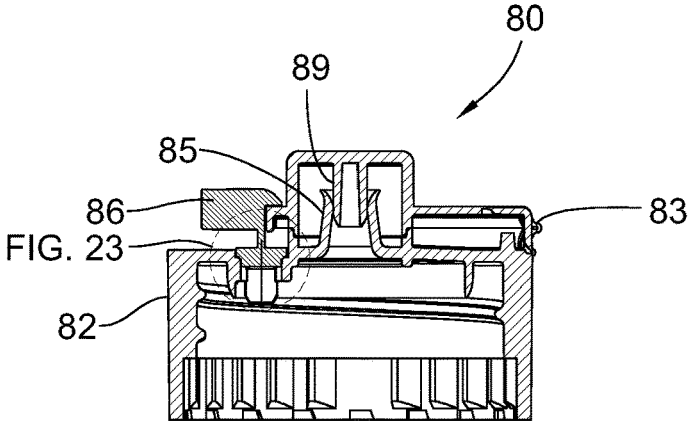
FIG. 22 is a front elevational view, in full section, of the FIG. 21 closure.
Figure 23:
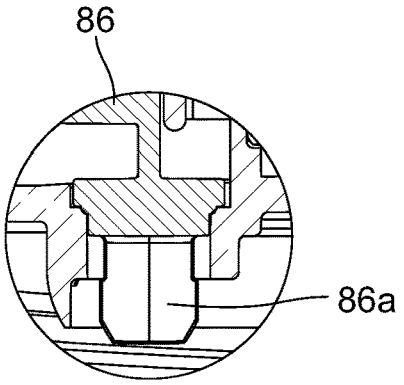
FIG. 23 is an enlarged detail of one feature of the FIG. 18 closure.
Figure 24:
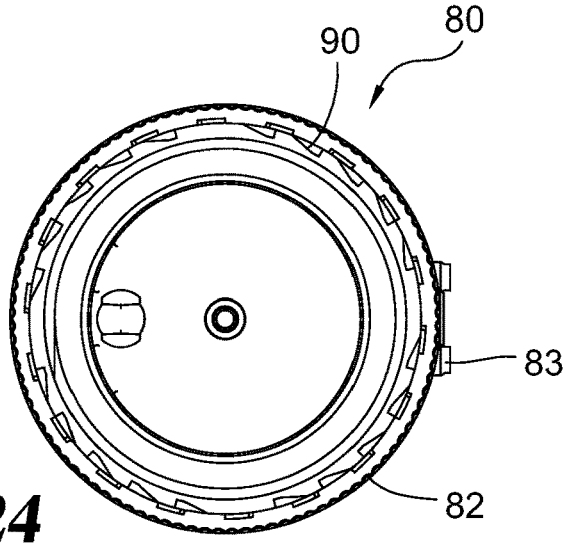
FIG. 24 is a bottom plan view of the FIG. 21 closure
Figure 25:
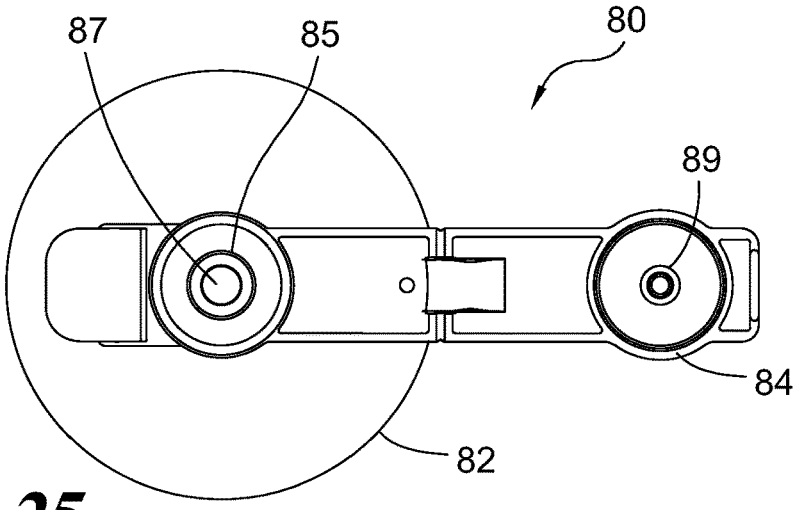
FIG. 25 is a top plan view, not as an exploded view, of the FIG. 20 closure.
Figure 26:
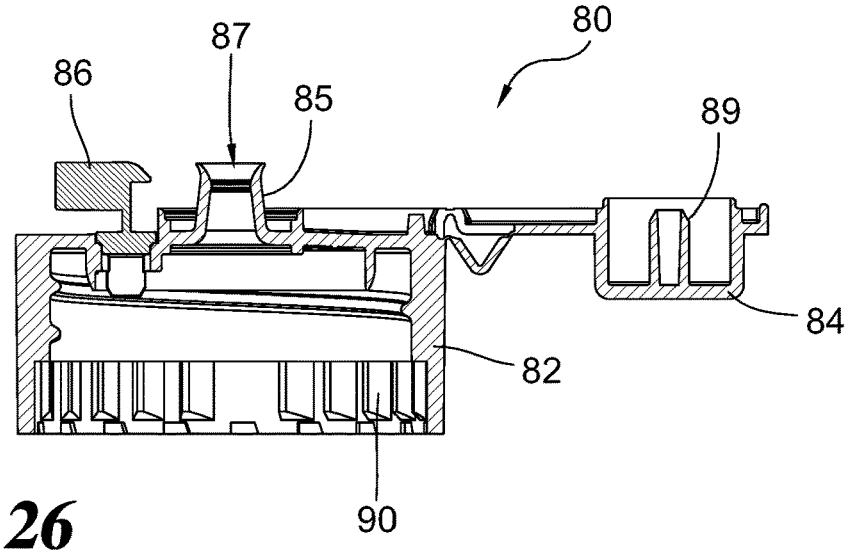
FIG. 26 is a front elevational view, in full section, of the FIG. 25 closure.
Figure 27:
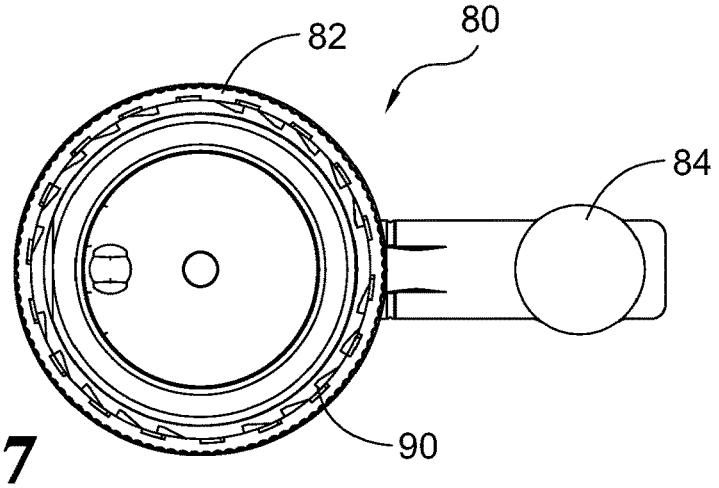
FIG. 27 is a bottom plan view of the FIG. 25 closure.

Reference will now be made in detail to exemplary embodiments of the present invention, examples of which are illustrated in the accompanying drawings. It is to be understood that other embodiments may be utilized and structural and functional changes may be made without departing from the respective scope of the invention. As such, the following description is presented by way of illustration only and should not limit in any way the various alternatives and modifications that may be made to the illustrated embodiments and still be within the spirit and scope of the invention.

As used herein, the words "example" and "exemplary" mean an instance, or illustration. The words "example" or "exemplary" do not indicate a key or preferred aspect or embodiment. The word "or" is intended to be inclusive rather an exclusive, unless context suggests otherwise. As an example, the phrase "A employs B or C," includes any inclusive permutation (e.g., A employs B; A employs C; or A employs both B and C). As another matter, the articles "a" and "an" are generally intended to mean "one or more" unless context suggest otherwise.

Referring to FIGS. 1 through 8, there is illustrated a first exemplary embodiment of a child-resistant, flip-top closure 20 according to the present invention. Closure 20 includes a retaining collar 22 defining a locking notch 24. Lid 26 is hinged to closure body 28 by a living hinge 23 to enable a single-piece construction. The retaining collar 22 is integrally molded with closure body 28 for this single-piece component. Lid 26 is constructed and arranged with outwardly extending tabs **26*a* which may be used for lifting of lid 26 in order to move the lid from a close condition to an open condition so as to access the contents of the container to which closure 20** is securely connected. The corresponding container is not illustrated for any of the disclosed embodiments.

Lid 26 includes a locking tab **26*b* which is received within the locking notch 24 to define a closed condition for the container. In this closed or starting condition the closure 20 has closed or sealed off the opening 25 of the closure body so as to prevent access to the contents of the container. The specific construction for sealing off for closing opening 25 is by means of plug 27 which fits snugly into opening 25. Squeezing inwardly on the sides 22***a* of collar 22 creates a shape change of collar 22 and of locking notch 24 which in turn releases tab 26*b*. Concurrently, while this first manipulation is being performed, lifting upwardly on tabs 26*a*, while still squeezing sides 22*a*, allows closure 20 to be opened by lifting up on lid 26. The action of lifting upwardly on lid 26 allows lid 26 to pivot relative to the closure body with a hinged action thereby moving the lid from a closed condition to an open conditions such that the container is now open and the contents of that container are accessible. The side wall of the closure body 28 is optionally formed with a series of ratchets 30 for securement to the neck of the corresponding container.

Referring to FIGS. 9 through 17, there is illustrated a second exemplary embodiment of a child-resistant, flip-top closure 50 according to the present invention. The disclosed closure 50 is a single-piece molded plastic construction. Closure 50 includes a closure body 52 and a lid 54 which is hinged to the closure body 52 by a living hinge 53. The child-resistant construction of closure 50 includes a locking tab 56 which must be pushed in an axially downward direction in order to release the lid 54 from a closed and locked condition. The lid 54 includes a protruding portion 55 which is secured by locking tab 56 when the lid is closed, so as to prevent opening.

Closure body 52 includes a dispensing opening 57 in the form of an annular spout. Lid 54 includes a cooperating plug 59 which is sized and arranged for insertion into opening 57 with a snug fit to ensure proper sealing. Simple lifting on lid 54 will not open the container due to the locked engagement between locking tab 56 and protruding portion 55. In order to open the closure 50 for access to the contents of the cooperating container, the user must push downwardly on tab 56 and concurrently lift lid 54. These combined, concurrent manipulations of push and lift allow the user to pivot the lid to an open condition in order to have access to the container contents. The side wall of the closure body 52 is optionally formed with a series of ratchets 60 for securement of the closure 50 to the neck of the corresponding container.

Referring to FIGS. 18 through 27, there is illustrated a third embodiment of a child-resistant, flip-top closure 80 according to the present invention. Closure 80 includes as an assembled combination, a closure portion 81 and a locking tab 86. The closure portion 81 comprises closure body 82 and a lid 84 which is hinged to the closure body 82 by a living hinge 83. The closure portion 81 is molded as a single-piece component. The child-resistant construction includes, as a separate component part, the locking tab 86. Locking tab 86 has a snap-in construction with a split post 86*a* which is pressed into a receiving opening 87 in the closure body 82 for its snap-in assembly. Once the locking tab 86 is assembled into the remainder of the closure, i.e. into the closure portion 81, the locking tab 86 becomes operable for providing part of the child-resistant capability. Pressing downwardly (axially downward) on locking tab 86 allows lid 84 to be lifted, i.e. pivoted to an open condition. The child-resistant capabilities provided by the fact that the locking tab 86 must be pushed downwardly concurrently with the lifting action on lid 84.

Included as a part of the closure body 82 is an annular spout 85 defining a dispensing opening 87. When the lid 84 is closed (see FIGS. 18 and 22), plug 89 is inserted into dispensing opening 87 in a snug manner so as to close the dispensing opening 87. The side wall of the closure body 82 is optionally formed with a series of ratchets 90 for securement of the closure 80 to the neck of the corresponding container.

Figure 28:
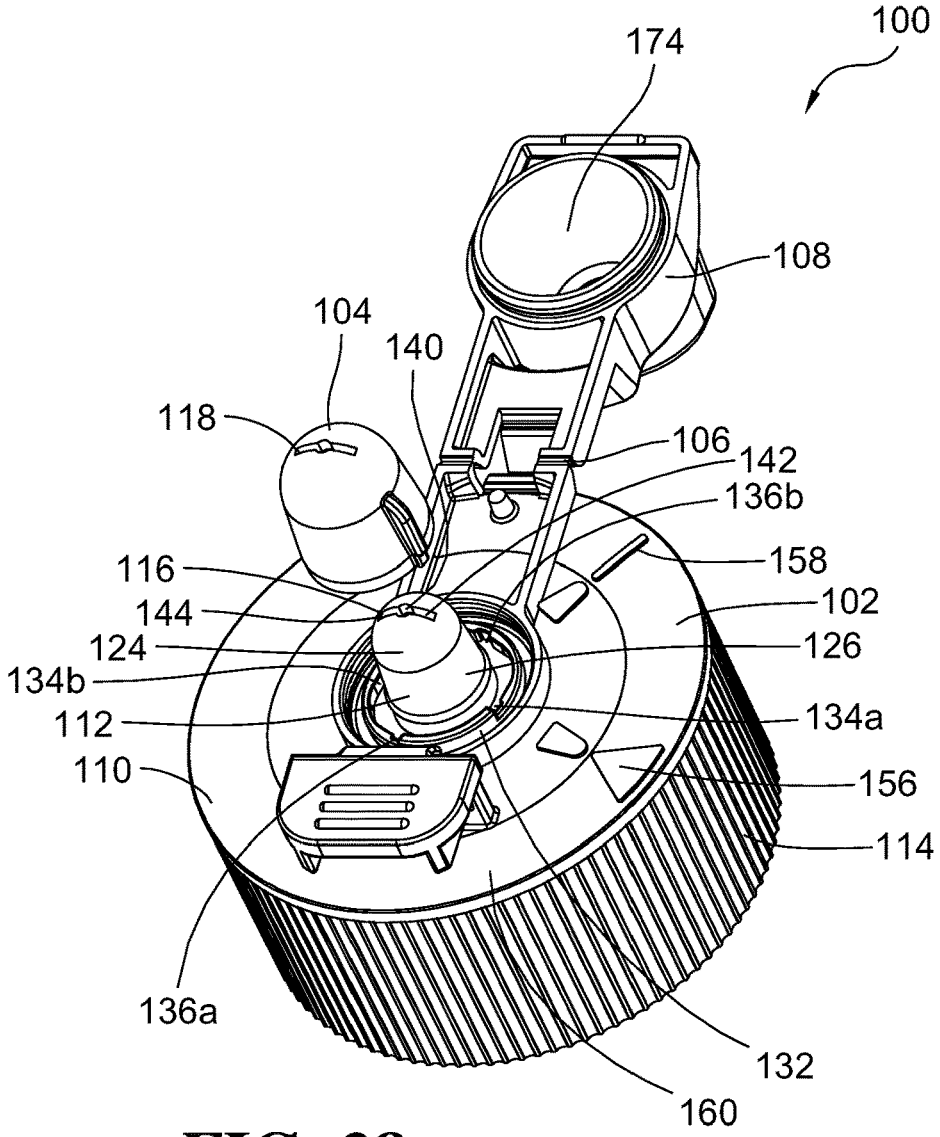
FIG. 28 is an exploded, slightly enlarged perspective view of a child-resistant, flip-top closure in an open condition according to one embodiment of the present invention.
Figure 29:
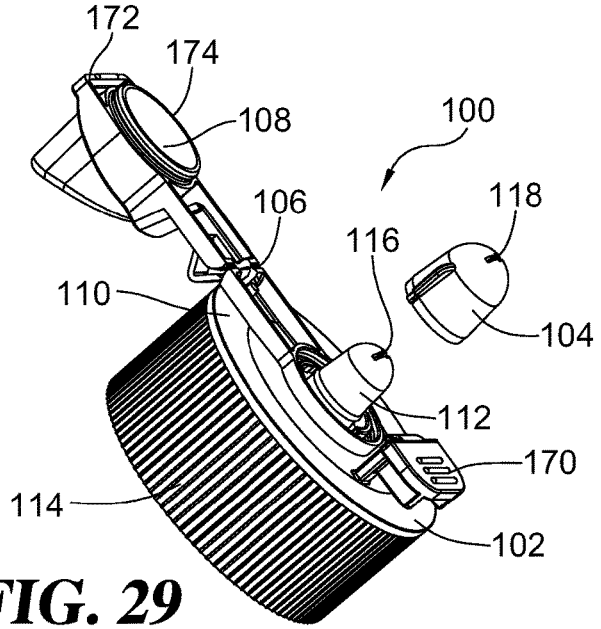
FIG. 29 is an exploded, perspective view of the FIG. 28 closure.
Figure 30:
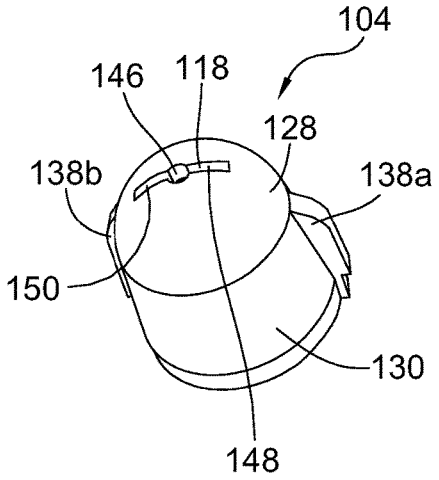
FIG. 30 is a perspective view of a nozzle which comprises one component part of the FIG. 28 closure.
Figure 31:
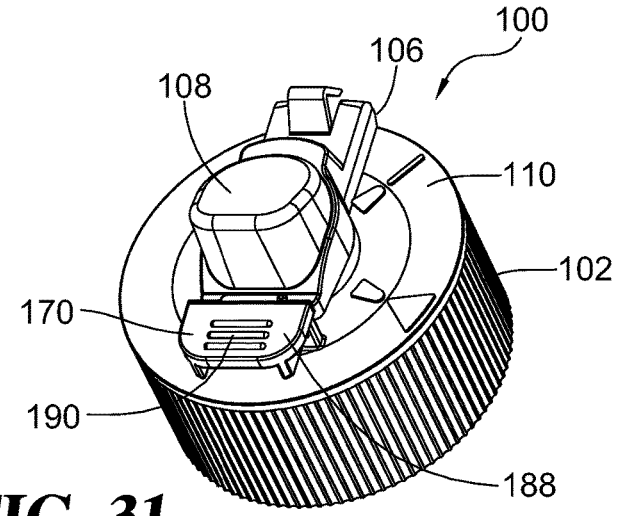
FIG. 31 is a perspective view of the FIG. 28 closure in a closed condition.
Figure 32:
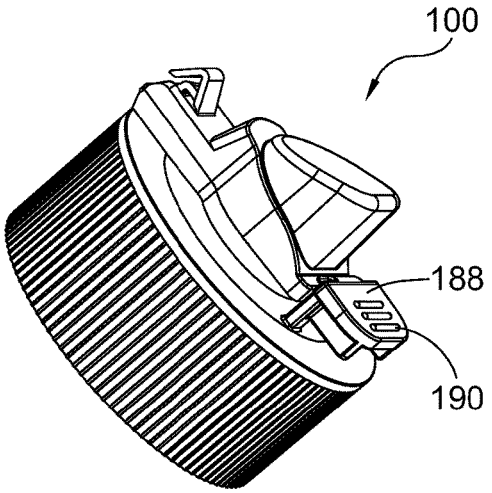
FIG. 32 is a perspective view of the FIG. 28 closure in a closed condition.
Figure 33:
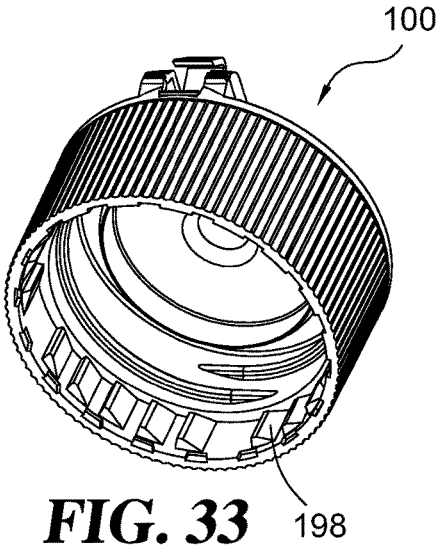
FIG. 33 is a perspective view of the FIG. 28 closure in a closed condition.
Figure 34:
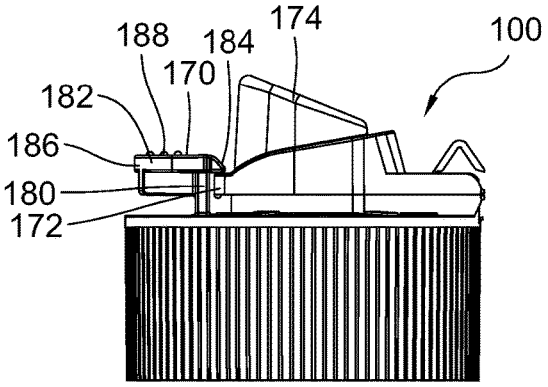
FIG. 34 is a front elevational view of the FIG. 28 closure.
Figure 35:
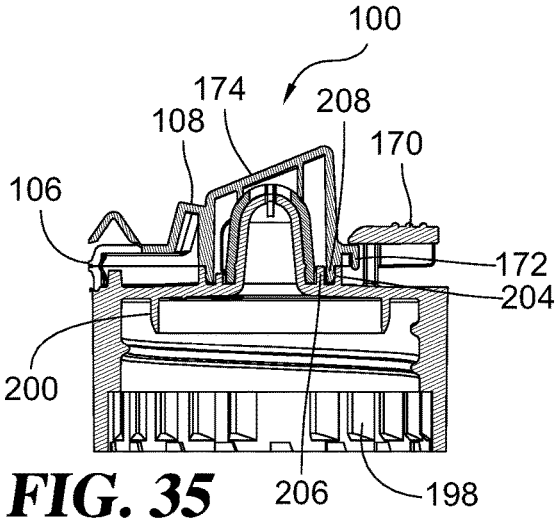
FIG. 35 is a rear elevational view, in full section, of the FIG. 28 closure.
Figure 36:
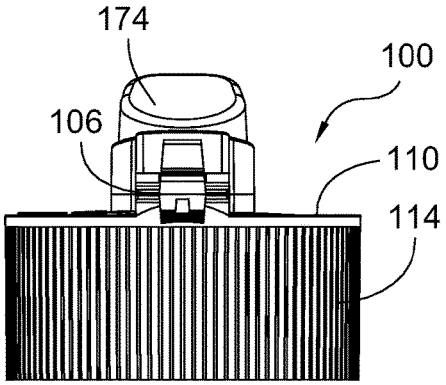
FIG. 36 is a right side elevational view of the FIG. 28 closure.
Figure 37:
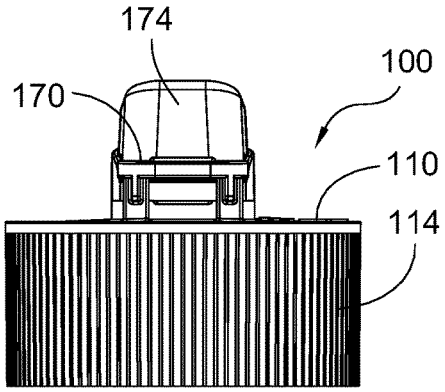
FIG. 37 is a left side elevational view of the FIG. 28 closure.
Figure 38:
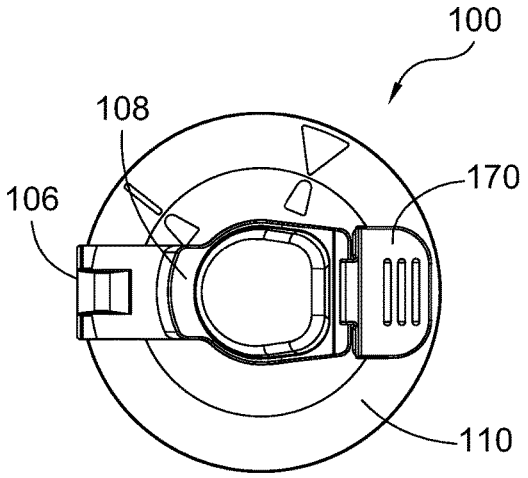
FIG. 38 is a top plan view of the FIG. 28 closure.
Figure 39:
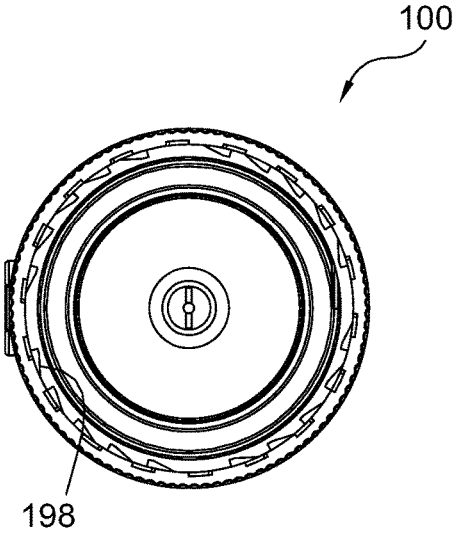
FIG. 39 is a bottom plan view of the FIG. 28 closure.
Figure 40:
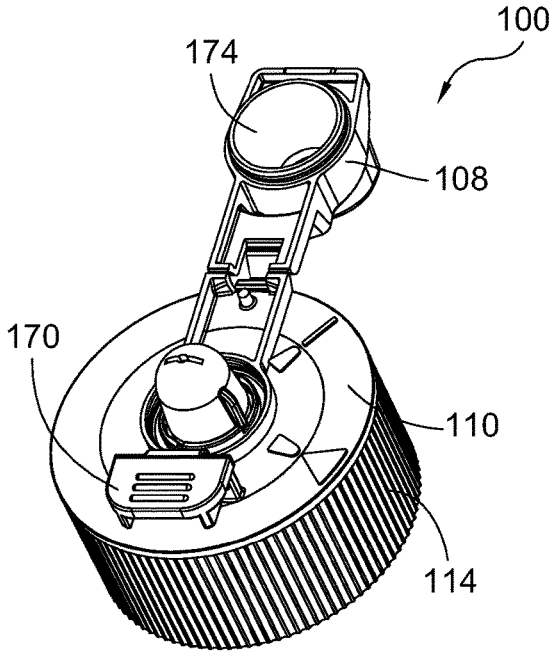
FIG. 40 is a perspective view, not exploded, of the FIG. 28 closure in an open condition.
Figure 41:
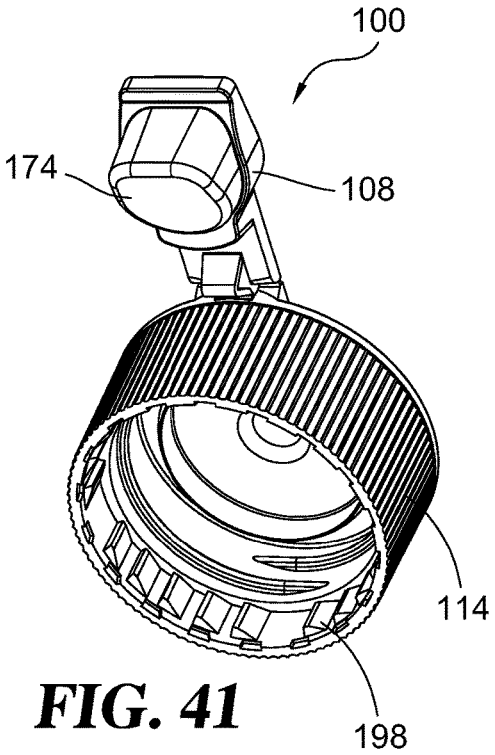
FIG. 41 is a perspective view of the FIG. 40 closure.
Figure 42:
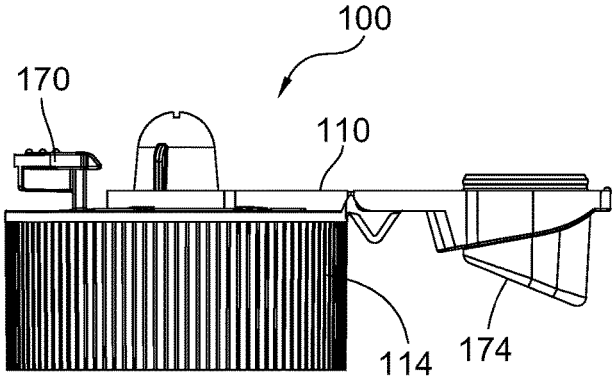
FIG. 42 is a front elevational view of the FIG. 40 closure.
Figure 43:
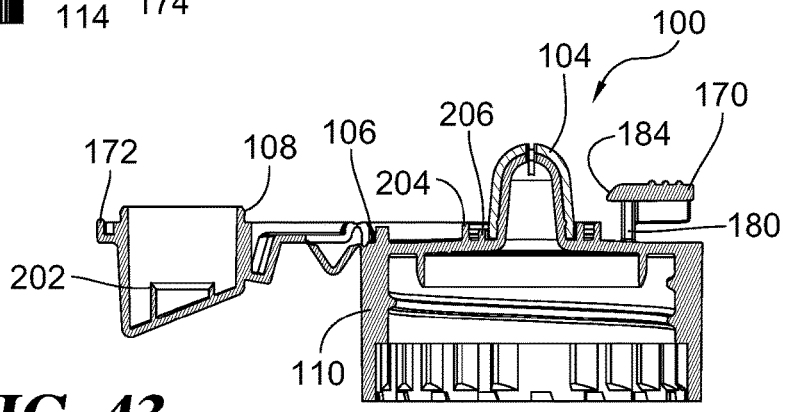
FIG. 43 is a rear elevational view, in full section, of the FIG. 40 closure.
Figure 44:
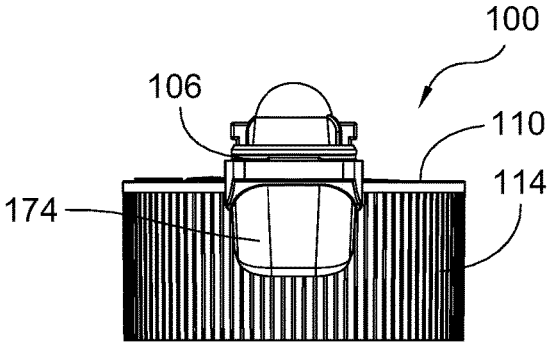
FIG. 44 is a right side elevational view of the FIG. 40 closure.
Figure 45:
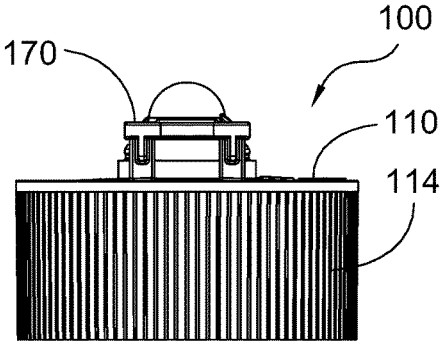
FIG. 45 is a left side elevational view of the FIG. 40 closure.
Figure 46:
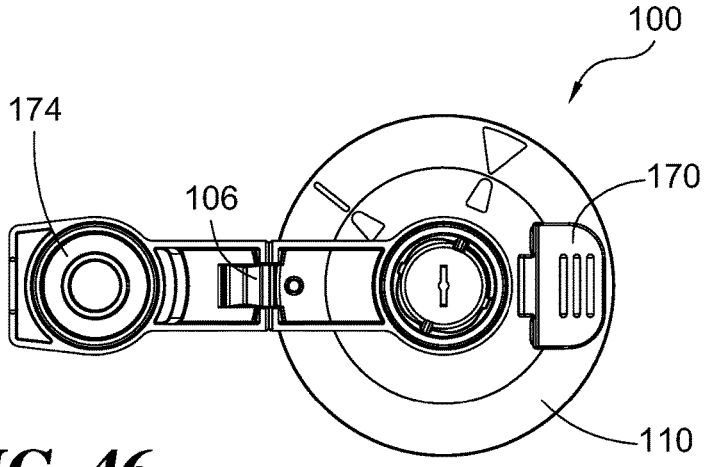
FIG. 46 is a top plan view of the FIG. 40 closure.
Figure 47:
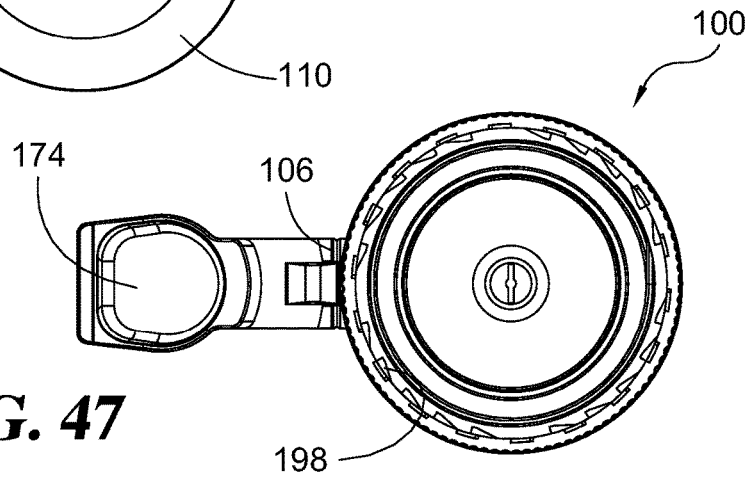
FIG. 47 is a bottom plan view of the FIG. 40 closure.
Figure 48:
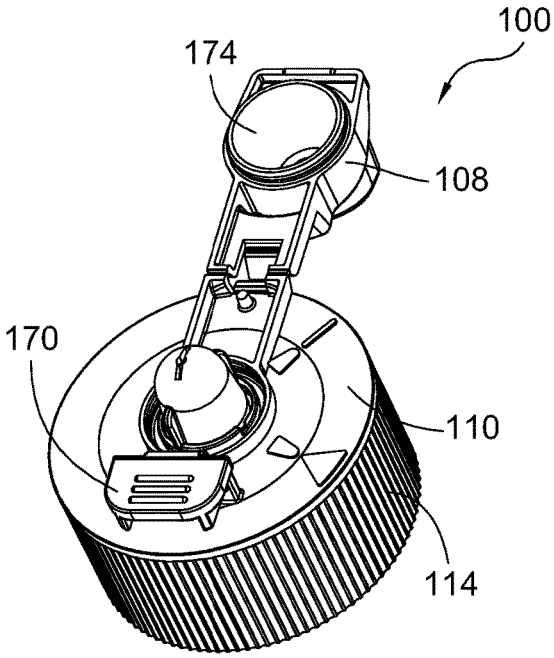
FIG. 48 is a perspective view, not exploded, of the FIG. 28 closure with the FIG. 30 nozzle component rotated to a different dispensing pattern position.
Figure 49:
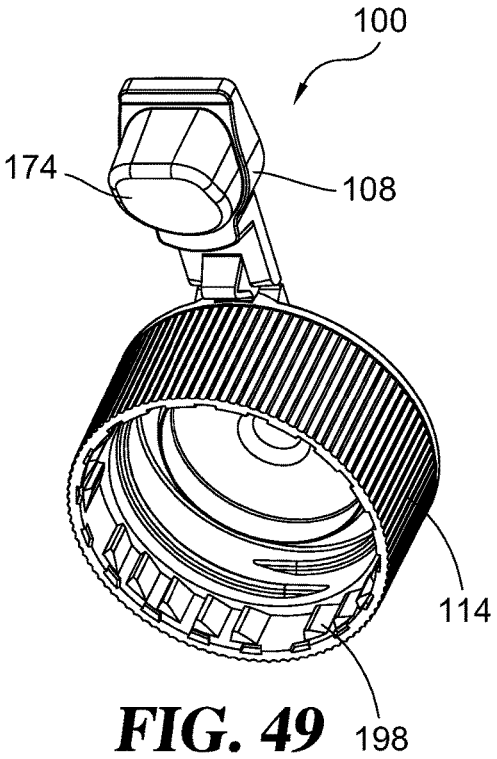
FIG. 49 is a perspective view of the FIG. 48 closure.
Figure 50:
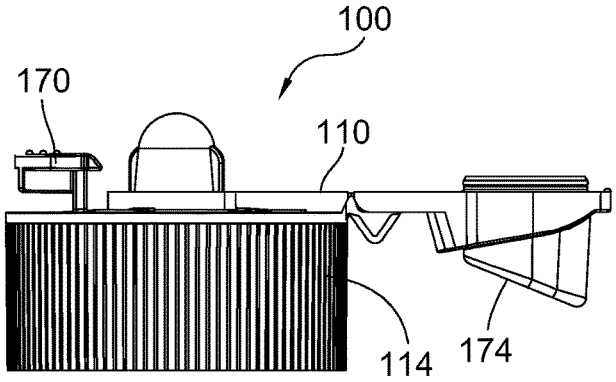
FIG. 50 is a front elevational view of the FIG. 48 closure.
Figure 51:
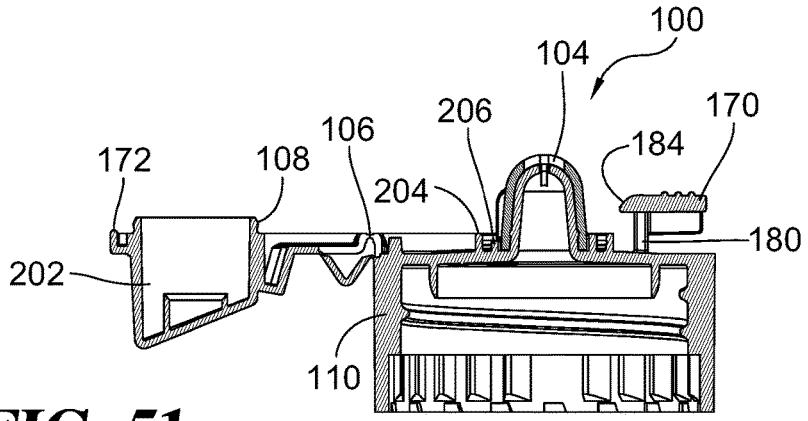
FIG. 51 is a rear elevational view, in full section, of the FIG. 48 closure.
Figure 52:
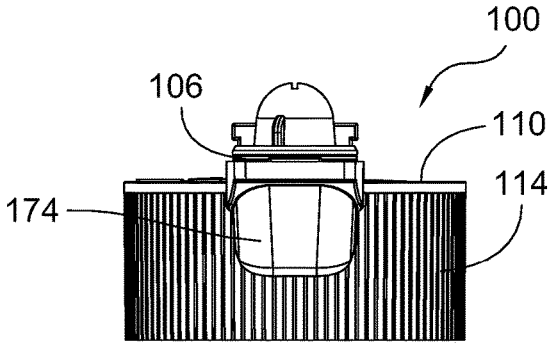
FIG. 52 is a right side elevational view of the FIG. 48 closure.
Figure 53:
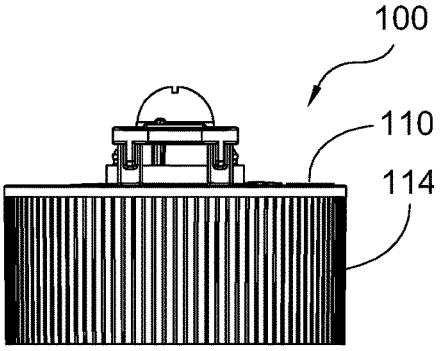
FIG. 53 is a left side elevational view of the FIG. 48 closure.
Figure 54:
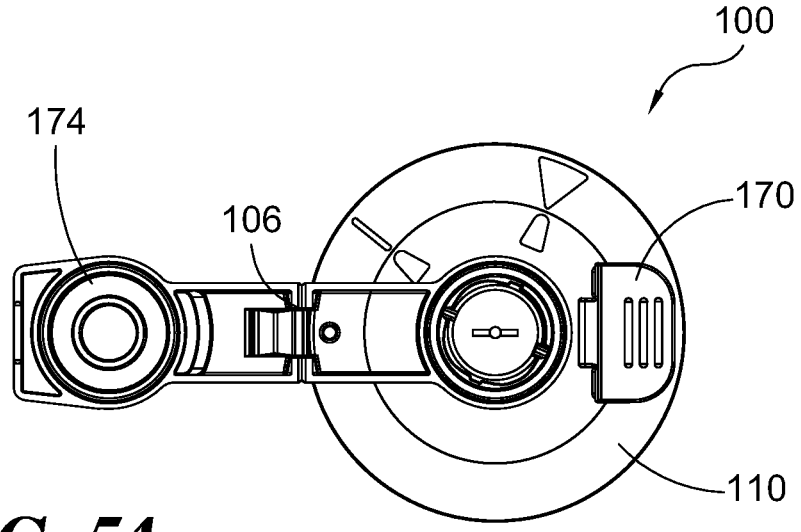
FIG. 54 is a top plan view of the FIG. 48 closure.
Figure 55:
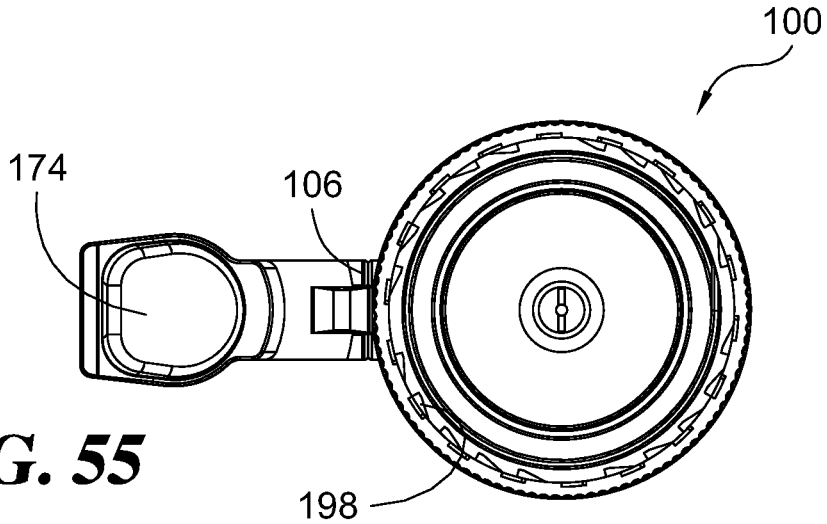
FIG. 55 is a bottom plan view of the FIG. 48 closure.

Referring now to FIGS. 28 through 30 there is illustrated a child-resistant, flip-top closure 100 according to another embodiment of the present invention. Closure 100 includes a closure base 102 and a separate nozzle 104. In the exemplary embodiment which is illustrated in FIGS. 28 through 30, closure base 102 is a single-piece component, molded out of a suitable plastic, including a living hinge 106. This living hinge 106 connects together the flip-top cap 108 with the closure body 110. Closure body 110 includes dispensing spout 112 which is substantially concentrically positioned with respect to the generally cylindrical sidewall 114. Dispensing spout 112 defines a slotted opening 116 for the dispensing of a flowable product which is retained or stored in the cooperating container (not illustrated). The nozzle 104 fits down over dispensing spout 112. Nozzle 104 defines a slotted opening 118 for the dispensing of the flowable product which is exiting the container (and the closure base 102) by way of slotted opening 116.

Dispensing spout 112 has a rounded top portion 124 and a frustoconical body 126 with a slight taper, converging toward the top portion 124. Nozzle 104 has a construction and arrangement which is similar to dispensing spout 112, including a rounded top portion 128 and a frustoconical body 130. The respective sizes and shapes of dispensing spout 112 and nozzle 104 are compatible so as to enable the nozzle 104 to fit closely and securely down onto dispensing spout 112. When the dispensing spout 112 and nozzle 104 are properly assembled together, slotted opening 118 is positioned over slotted opening 116.

As a part of closure body 110 and formed as a generally concentric ring around the base of dispensing spout 112 is detent wall 132. Detent wall 132 defines a first pair of notches 134*a* and 134*b* which are positioned approximately 180 degrees apart. Detent wall 132 further defines a second pair of notches 136*a* and 136*b* which are positioned approximately 180 degrees apart. Nozzle 104 includes a pair of outwardly extending or radially protruding axial ribs 138*a* and 138*b* which are positioned approximately 180 degrees apart. This particular spacing is important such that ribs 138*a* and 138*b* are sized and arranged to fit into either the first pair of notches 134*a* and 134*b* or alternatively to fit into the second pair of notches 136*a* and 136*b*. In view of the respective sizes, the plastic materials which are used and the degree of detent engagement of the ribs 138*a* and 138*b* into one or the other of the pair of notches, the nozzle 104 is able to be manually rotated from one pair of notches requiring disengagement to the other pair of notches resulting in engagement. This disengagement is from the detent capture of the ribs by the first pair of notches allowing the nozzle 104 to move to the second pair of notches where those ribs engage into the detent structure.

The degrees of travel (i.e. the amount of rotation of nozzle 104 on dispensing spout 112) from detent engagement with one pair of notches to detent engagement with the other pair of notches can be varied. In the exemplary embodiment of FIGS. 28 through 30, the degrees of rotation of nozzle 104 for movement from a first detent engagement position to a second detent engagement position is approximately 45 degrees. As noted, this selected degree of rotation from one point of engagement to the other can be varied.

The first pair of notches 134*a* and 134*b* represent a first engagement position for nozzle 104 which is constructed and arranged to generate a dispensing pattern for the product content of the container as that product content is dispensed.

This particular dispensing pattern when the first pair of notches 134*a* and 134*b* are engaged is in the form of a radiating spray pattern. The second pair of notches 136*a* and 136*b* represent a second engagement position for nozzle 104 relative to dispensing spout 112 which is constructed and arranged to generate a dispensing pattern for the product content of the container in the form of a stream. It is the positioning and orientation of the slotted opening 118 relative to slotted opening 116 which determines, at least in part, the dispensing pattern which will be created as product is being dispensed. The slotted opening shapes and the centered circular opening play a part in the spray or stream pattern as will be seen in alternative embodiments.

Slotted opening 116 defines a generally circular region 140 which has a diametrical size which is larger than the width of slotted sections 142 and 144. Generally circular region 140 is substantially centered between the closed ends of slotted sections 142 and 144. In a similar manner slotted opening 118 defines a generally circular region 146 which has a diametrical size which is larger than the width of slotted sections 148 and 150. Generally circular region 146 is substantially centered between the closed ends of slotted sections 148 and 150. The compatible sizing and shaping of nozzle 104 and of dispensing spout 112 and the similar sizing and positioning of slotted openings 116 and 118 causes generally circular region 146 to be concentric with generally circular region 140 in an overlapping manner. Preferably the diametrical size of region 146 is the same as the diametrical size of region 140. When the slotted openings 116 and 118 are fully aligned for their longitudinal extent, such that slotted sections 148 and 150 are aligned and overlapping manner with slotted sections 142 and 144, the dispensing pattern of the flowable product from the container is a spray pattern as the flowable product is dispensed from a slotted opening having a narrow width compared to its longitudinal length. When the nozzle 104 is turned to a second setting wherein the two slotted openings 116 and 118 are not fully aligned longitudinally, and principally only the circular regions 140 and 146 are in line, the dispensing pattern of the flowable product is in the form of a stream as the flowable product is dispensed from a generally circular opening. These two selectable spray patterns are identified by raised icons 156 (spray pattern) and 158 (stream pattern). Raised icons 156 and 158 are molded into the upper panel 160 of closure body 110 so as to be clearly visible to the individual intending to dispense the flowable product. The visibility is maintained even when the hood 174 is hinged into a closing position.

Closure 100 is constructed and arranged as a child-resistant closure. One option for creating a child-resistant closure is to make the closing or locking mechanism for the flip-top cap, such as flip-top cap 108, a tight engagement. By designing the child-resistant feature with tight engagement, it is anticipated that young children are not likely to have the necessary strength and dexterity to pull or lift the flip-top cap out of engagement with the cooperating structure which defines the interfit partner. While a child-resistant construction which relies on a tight interfit may be suitable to prevent young children from gaining access to the contents of the container, this tight interfit will not always be suitable for others, particularly for others with arthritic conditions of the hands. Accordingly, as an improvement in addressing this further concern, the design of closure 100 includes a child-resistant construction which removes the tight interfit and instead employs as the child-resistant philosophy, the need to perform two manual manipulations concurrently. This dual manipulation requirement is difficult for young children to perform. However, at the same time this child-resistant approach eliminates the tight interfit of other designs so as to enable those with arthritic conditions of the hands to easily open the closure to be able to dispense the product contents of the container.

Referring now to FIGS. 31 through 55, the child-resistant construction of closure 100 is provided by the use of a press tab 170 which is unitarily molded as a part of closure body 110 in cooperation with a protruding lip 172 which is unitarily molded as a part of flip-top cap 108. As illustrated in FIGS. 31 through 55, when the closure 100 is in a closed condition with the flip-top cap 108 hinged over onto the closure body 110, the hood 174 is hinged into a closing position fitting down over the top of nozzle 104. In this closed condition the protruding lip 172 is located axially beneath press tab 170 such that any attempt to lift upwardly on flip-top 108 results in abutment between the upper surface of protruding lip 172 against the undersurface of press tab 170. This abutment prevents the opening of closure 100 in the intended manner by preventing the hinged lifting or raising (pivotally) of flip-top cap 108. It is only after the abutment between protruding lip 172 and press tab 170 is removed that the flip-top cap 108 is able to be lifted in the normal or intended manner.

In order to allow the flip-top cap 108 to be lifted (i.e. upwardly hinged) to an open condition, the press tab 170 must first be pivoted out of its overlapping condition with protruding lip 172. This pivoting movement for press tab 170 is accomplished in the following manner based on the described construction. As is illustrated, the press tab 170 includes a post 180 and an upper panel 182. The post 180 is positioned between the ends of upper panel 182 such that abutment portion 184 is radially inwardly of post 180 and press-to-release portion 186 is radially outwardly of post 180. Post 180 thus represents a pivot point or hinge point (i.e. axis) for deflecting abutment portion 184 in an upward and outward direction in response to pressing down on press-to-release portion 186. The upper surface 188 of portion 186 includes a series of spaced-apart ribs 190 to both signify where to press and to provide a limited-slip surface. The upper surface of abutment portion 184 is inclined so as to easily deflect as it is engaged by lip 172 during the closing of cap 108. As the press-to-release portion 186 is pressed in an axially downward direction, the abutment portion 184 pivots out of its overlapping position over protruding lip 172. Once the abutment portion 184 is pivoted clear of the protruding lip 172, the flip-top cap 108 is able to be lifted (i.e. hinged open) to open the closure 100 and allow access to the container contents. This simultaneous pair of manual manipulations involving pressing down on the press-to-release portion 186 while concurrently lifting upwardly on flip-top cap 108 allows the child-resistant feature of closure 100 to be defeated and thereby allows the closure 100 to be opened.

With continued reference to FIGS. 28 through 55, other structural features of closure 100 are illustrated. First, the closure body 110 of closure 100 includes as a part of its generally cylindrical sidewall 114 an internally-threaded surface and an axially lower portion with a series of ratchets 198 for securely connecting closure 100 to the neck of a corresponding container which retains the product to be dispensed. A depending seal 200 is provided for fitting into the container opening (not illustrated) for additional sealing. Additionally, hood 174 includes a depending seal 202 for engagement around the upper portion of nozzle 104 for added sealing around slotted opening 118. For additional alignment and interfit of flip-top cap 108 with the closure body, the upper surface of closure body 110 includes a pair of generally concentric raised walls 204 and 206, and the flip-top cap includes an offset lower edge which is notched such that the thinner wall portion 208 of this offset lower edge fits between the two raised walls 204 and 206.

With reference to FIGS. 56-61 an alternative closure construction in the form of closure 214 is illustrated. Closure 214 is essentially the same as closure 100 with the exception of the slotted openings 116 and 118 which are now replaced by and identified as apertures 216*a*-216*c* and slotted opening 218 for the construction of closure 214. The slotted opening 218 of rotatable nozzle 220 has the form of a longitudinal slit. In the exemplary embodiment of FIGS. 56-61, the circular region 146 of nozzle 104 has been eliminated such that slotted opening 218 is substantially straight for its entire length with a substantially uniform slot width from one end to the other.

Figure 56:
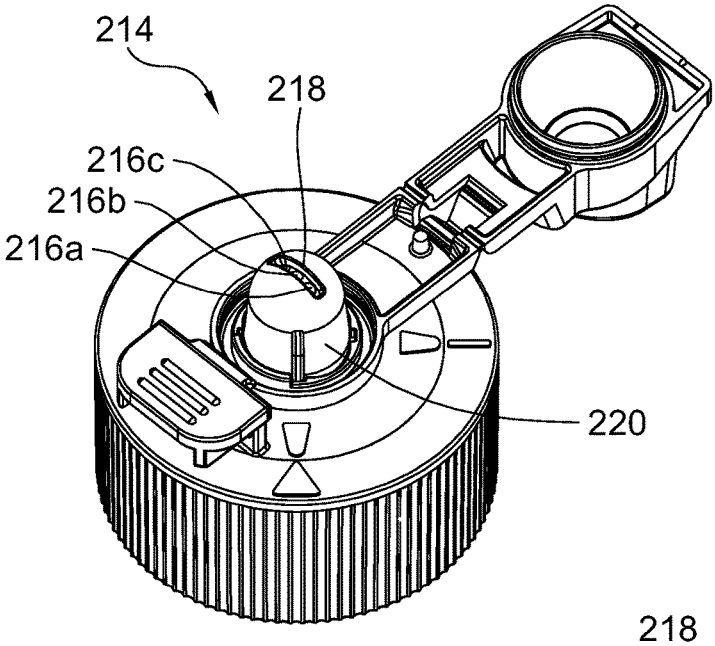
FIG. 56 is a perspective view of a child-resistant, flip-top closure in an open condition according to one embodiment of the present invention.
Figure 57:
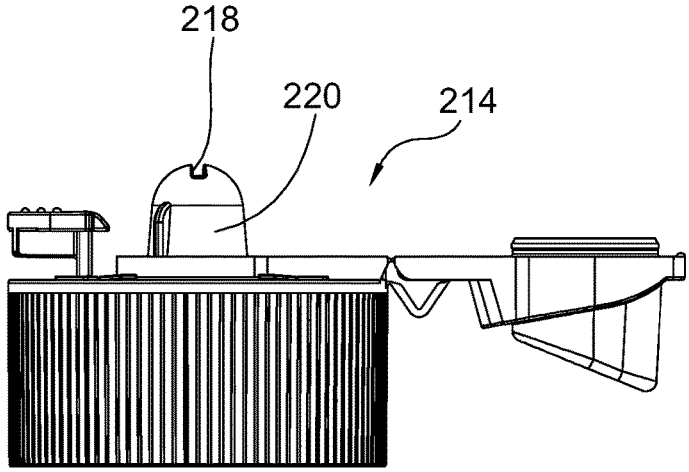
FIG. 57 is a front elevational view of the FIG. 56 closure.
Figure 58:
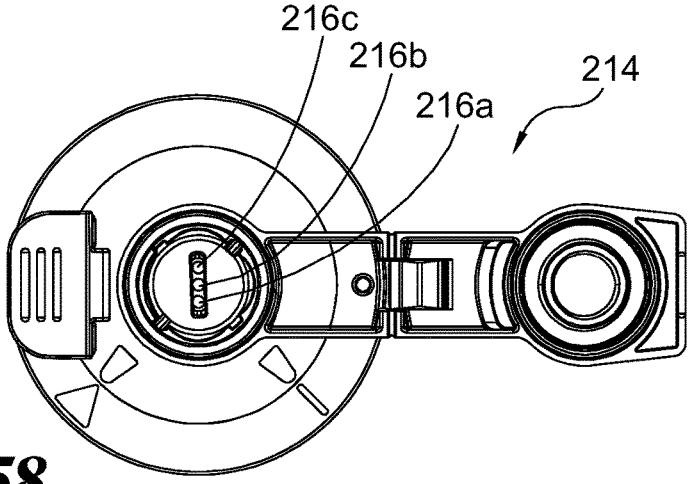
FIG. 58 is a top plan view of the FIG. 56 closure.
Figure 59:
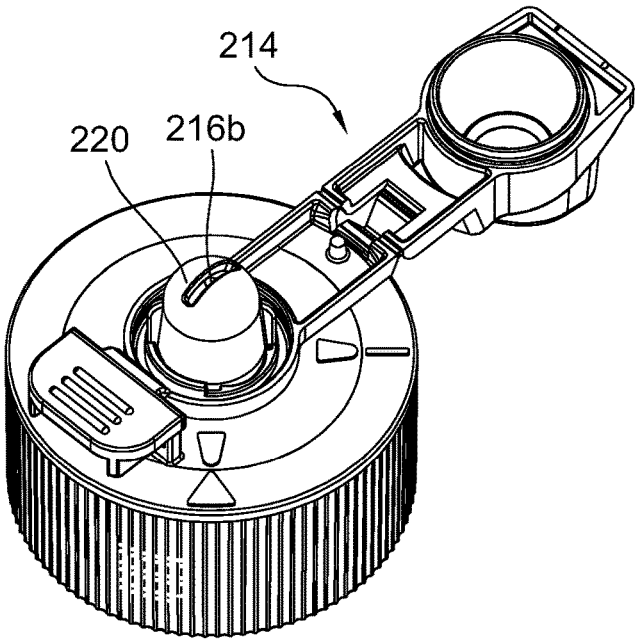
FIG. 59 is a perspective view of the FIG. 56 closure with the nozzle component rotated to a different dispensing pattern setting.

The cooperating structure of dispensing spout 220 has three aligned apertures 216*a*, 216*b* and 216*c* which have replaced slotted opening 116 of closure 100. Apertures 216*a*-216*c* are adjacent to each other in a generally straight line. As with closure 100, closure 214 is able to have its nozzle 220 turned for selection of the desired dispensing pattern between one of two engagement positions. FIGS. 56-58 show the nozzle 220 of closure 214 turned for the selection of a spray pattern for the liquid product of the container. In this orientation the slotted opening 218 is turned so as to align with all three apertures 216*a*-216*c*. Even though there are actually three streams of product created, one stream coming from each aperture, this pattern of three dispensing streams will actually merge together into a spray pattern. Considering the alignment and proximity of these three apertures 216*a*-216*c*, and noting the typical radiating pattern of any type of liquid spray or stream, a spray pattern is created by the collective contributions of the three streams exiting from the three apertures 216*a*-216*c* via slotted opening 218.

Figure 60:
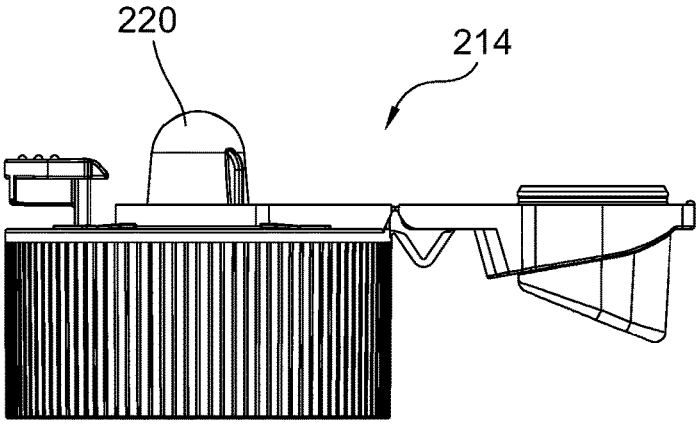
FIG. 60 is a front elevational view of the FIG. 59 closure.
Figure 61:
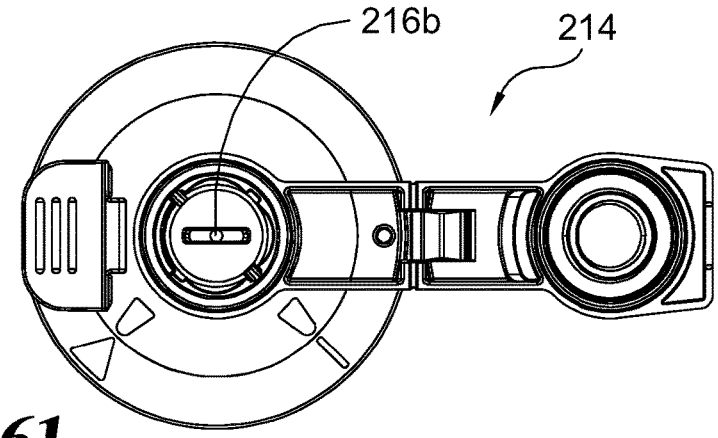
FIG. 61 is a top plan view of the FIG. 59 closure.
Figure 62:
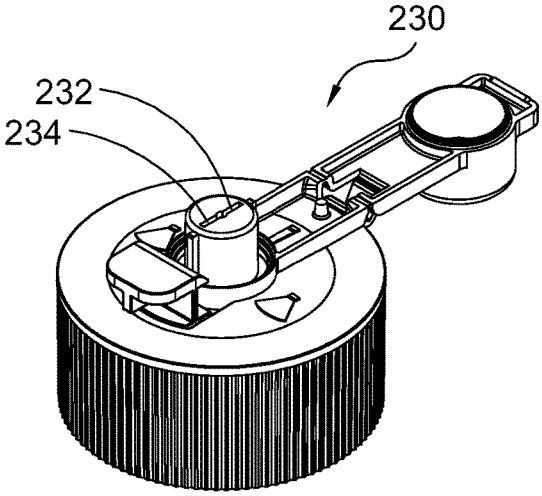
FIG. 62 is a perspective view of a child-resistant, flip-top closure in an open condition according to one embodiment of the present invention.
Figure 63:
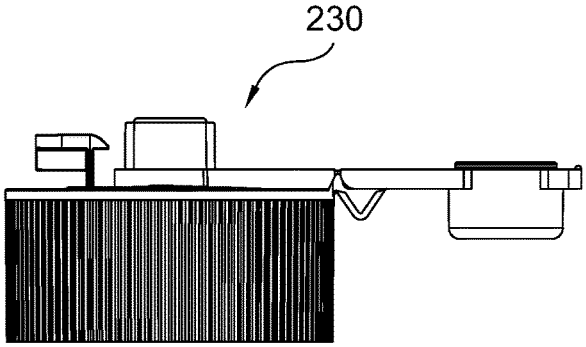
FIG. 63 is a front elevational view of the FIG. 62 closure.
Figure 64:
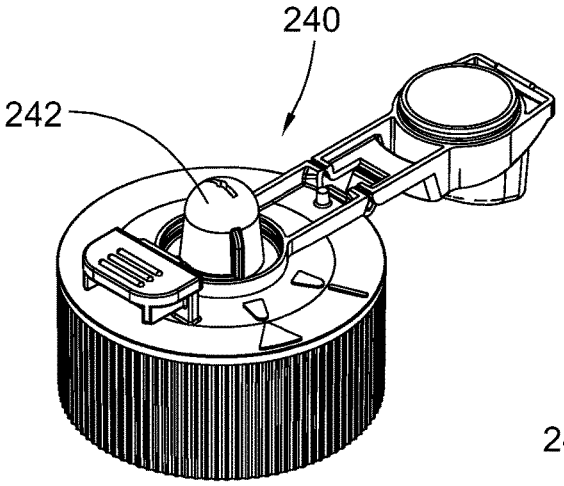
FIG. 64 is a perspective view of a child-resistant, flip-top closure in an open condition according to one embodiment of the present invention.
Figure 65:
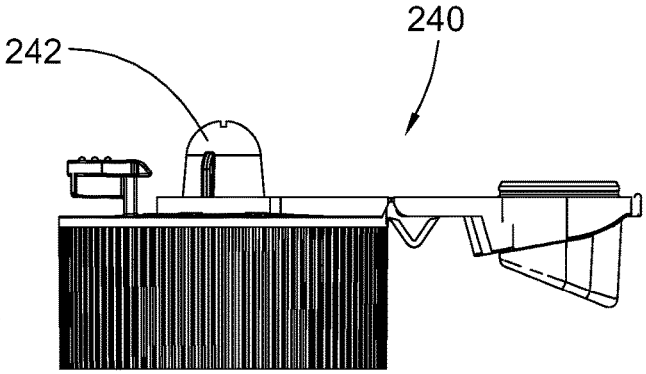
FIG. 65 is a front elevational view of the FIG. 64 closure.
Figure 66:
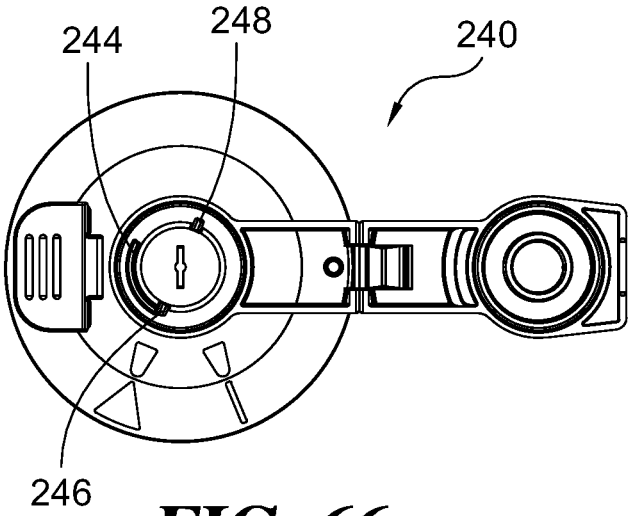
FIG. 66 is a top plan view of the FIG. 64 closure.

When the nozzle 220 is turned to its second detent position of engagement (see FIGS. 59-61), slotted opening 218 only aligns with the center aperture 216*b* (see FIG. 60). In this overlapping position the other two apertures 216*a* and 216*c* are closed off by the unclotted part of nozzle 220. With only a single aperture being used for dispensing of the liquid product from the container, the dispensing pattern for this position of engagement is in the form of a stream.

Referring now to FIGS. 62 through 66, alternative constructions to closure 100 are illustrated. Closure 100 is constructed and arranged with a selectable dispensing pattern for the fluid product of the container, either a spray pattern or a stream. By the rotational turning of nozzle 104 one of these two dispensing patterns can be selected by the user prior to dispensing the fluid product. Further, in the construction of closure 100 the degrees of rotation of nozzle 104 from one pattern selection to the other pattern was set at approximate 45 degrees, for the exemplary embodiment, including positive detents so as to indicate when a dispensing pattern has been selected. The positive detents provide both a tactile and an audible indication of the nozzle 104 position when engaged such that its ribs engage a notch detent. In the construction of closure 230 (see FIGS. 62 and 63) only a single spray pattern is provided. The dispensing outlet 232 defines a single longitudinal slit 234. A movable nozzle component is not required as there is only one spray pattern which is designed into closure 230.

In the construction of closure 240 (see FIGS. 64 through 66), there are two selectable spray patterns enabled by the rotational positioning of nozzle 242. In this alternative construction either a spray pattern or stream can be selected by the orientation of nozzle 242. These two settings are positioned approximate 45 degrees apart, but without the positive detents which form a part of closure 100. Instead, in the alternative construction of closure 240 a stopper or abutment wall 244 is provided. This abutment wall 244 has a fixed circumferential extent for abutment with either a first rib 246 or a second rib 248 which are formed as part of nozzle 242. As would be understood from what is been described and from the referenced drawing figures, rotating nozzle 242 in a first direction creates abutment by the first rib 246 against a first end of abutment wall 244. This abutment denotes the proper positioning of nozzle 242 for one selectable spray pattern. In the reverse direction of rotation of nozzle 242, the second rib 248 abuts against the opposite end of abutment wall 244 to denote the positioning for selection of the other spray pattern.

Other structures and features may be discerned from the attached drawings. By way of example rather than limitation, these features may include dimensions and relative proportions and/or ratios of the various components. In the same manner, certain ornamental features may augment the utilitarian functions of the disclosure.

Although the embodiments of the present invention have been illustrated in the accompanying drawings and described in the foregoing detailed description, it is to be understood that the present invention is not to be limited to just the embodiments disclosed, but that the invention described herein is capable of numerous rearrangements, modifications and substitutions without departing from the scope of the claims hereafter. The features of each embodiment described and shown herein may be combined with the features of the other embodiments described herein. The claims as follows are intended to include all modifications and alterations insofar as they come within the scope of the claims or the equivalent thereof.

We claim:

1. A child-resistant, flip-top closure comprising:

a closure body having a central outlet positioned between a locking tab and a hinge;

a cap attached to the hinge at one end and engages the locking tab an opposing end when the cap is depressed to seal the central outlet;

wherein the cap disengages the locking tab when concurrent releasing forces are exerted axially on the locking tab and pivotally on the cap;

wherein a detent is formed concentrically around the central outlet; and wherein a rotatable nozzle is fitted over the outlet.

2. The closure according to claim 1, wherein a plurality of ribs formed on the nozzle cooperate with notches formed on the detent, said ribs and the notches defining a range of motion through which the nozzle may be rotated relative to the central outlet.

3. The closure according to claim 2, wherein the range of motion alters a dispensing pattern for fluid dispensed through the outlet.

4. The closure according to claim 3, wherein the dispensing pattern is selected from a radiating spray and a stream.

5. The closure according to claim 4, wherein the outlet and the nozzle separately include slot-shapes and wherein each slot shape has an axially aligned, central aperture region of larger diameter in comparison to a width of the slot.

6. The closure according to claim 1, wherein a locking protrusion is formed on the opposing end of the cap.

7. The closure according to claim 2, wherein the ribs are spaced apart by approximately 180 degrees.

8. The closure according to claim 1, wherein the closure body includes cylindrical sidewalls extending axially downward on an opposite facing from where the cap seals the central outlet.

9. A child-resistant, flip-top closure comprising:

a closure body having a central outlet positioned between a locking tab and a hinge;

a cap attached to the hinge at one end and engages the locking tab an opposing end when the cap is depressed to seal the central outlet;

wherein the cap disengages the locking tab when concurrent releasing forces are exerted axially on the locking tab and pivotally on the cap;

wherein the locking tab includes an upright post attached to the closure body and a panel attached to the post; and wherein the panel absorbs the axially releasing force to flex the locking tab and disengage the cap.

10. The closure according to claim 9, wherein a locking protrusion is formed on the opposing end of the cap.

11. The closure according to claim 9, wherein the closure body includes cylindrical sidewalls extending axially downward on an opposite facing from where the cap seals the central outlet.

12. The closure according to claim 11, wherein the cylindrical sidewalls include at least one of internally threaded surfaces and a ratchet.

13. A child-resistant, flip-top closure comprising:

a closure body having a central outlet positioned between a locking tab and a hinge;

a cap attached to the hinge at one end and engages the locking tab an opposing end when the cap is depressed to seal the central outlet;

wherein the cap disengages the locking tab when concurrent releasing forces are exerted axially on the locking tab and pivotally on the cap;

wherein the closure body includes a concentric groove around the central outlet to snap-fittingly receive and release a corresponding thinned wall section on the cap; and wherein the thinned wall sections form a hood over the central outlet.

14. The closure according to claim 13, wherein a locking protrusion is formed on the opposing end of the cap.

15. The closure according to claim 13, wherein the closure body includes cylindrical sidewalls extending axially downward on an opposite facing from where the cap seals the central outlet.

16. The closure according to claim 15, wherein the cylindrical sidewalls include at least one of internally threaded surfaces and a ratchet.

17. The closure according to claim 8, wherein the cylindrical sidewalls include at least one of internally threaded surfaces and a ratchet.

* * * * *